United States Patent [19]

Ziegler

[11] Patent Number: 4,959,078

[45] Date of Patent: Sep. 25, 1990

[54] HOT-GAS COOLING PLANT

[75] Inventor: Georg Ziegler, Winterthur, Switzerland

[73] Assignee: Sulzer Brothers Limited, Winterthur, Switzerland

[21] Appl. No.: 416,542

[22] Filed: Oct. 3, 1989

[30] Foreign Application Priority Data

Oct. 26, 1988 [CH] Switzerland ..... 03986/88

[51] Int. Cl.[5] ..... C10J 3/82; C10J 3/84; C10J 3/86

[52] U.S. Cl. ..... 48/128; 48/69; 48/77; 55/269; 122/6 A; 122/7 R; 165/146

[58] Field of Search ..... 48/202, 62 R, 63, 64, 48/67, 69, 73, 77, DIG. 2; 55/269; 122/7 R, 6.6 A; 165/146, 147

[56] References Cited

U.S. PATENT DOCUMENTS 4,328,007 5/1982 Rafael ..... 48/73
4,493,291 1/1985 Zabelka ..... 48/67
4,807,698 2/1989 Köhnen et al. ..... 122/6 A

FOREIGN PATENT DOCUMENTS 2918859 11/1980 Fed. Rep. of Germany ... 48/DIG. 2
3512830 10/1985 Fed. Rep. of Germany .
516537 2/1955 Italy ..... 48/DIG. 2
889221 2/1962 United Kingdom .
2068095 8/1981 United Kingdom .

*Primary Examiner*—Peter Kratz
*Attorney, Agent, or Firm*—Kenyon & Kenyon

[57] ABSTRACT

The hot-gas cooling plant has a gas outlet line releasably connected between the radiant cooler and the convection cooler. The gas outlet line is curved to extend from an upper region of the radiant cooler to the top end of the convection cooler. Flange connections are used to connect the gas outlet line to the pressure vessels of the coolers. Cooling tubes are also provided within the gas outlet line for cooling the flow of gas therethrough.

11 Claims, 2 Drawing Sheets

HOT-GAS COOLING PLANT

Figure 1:
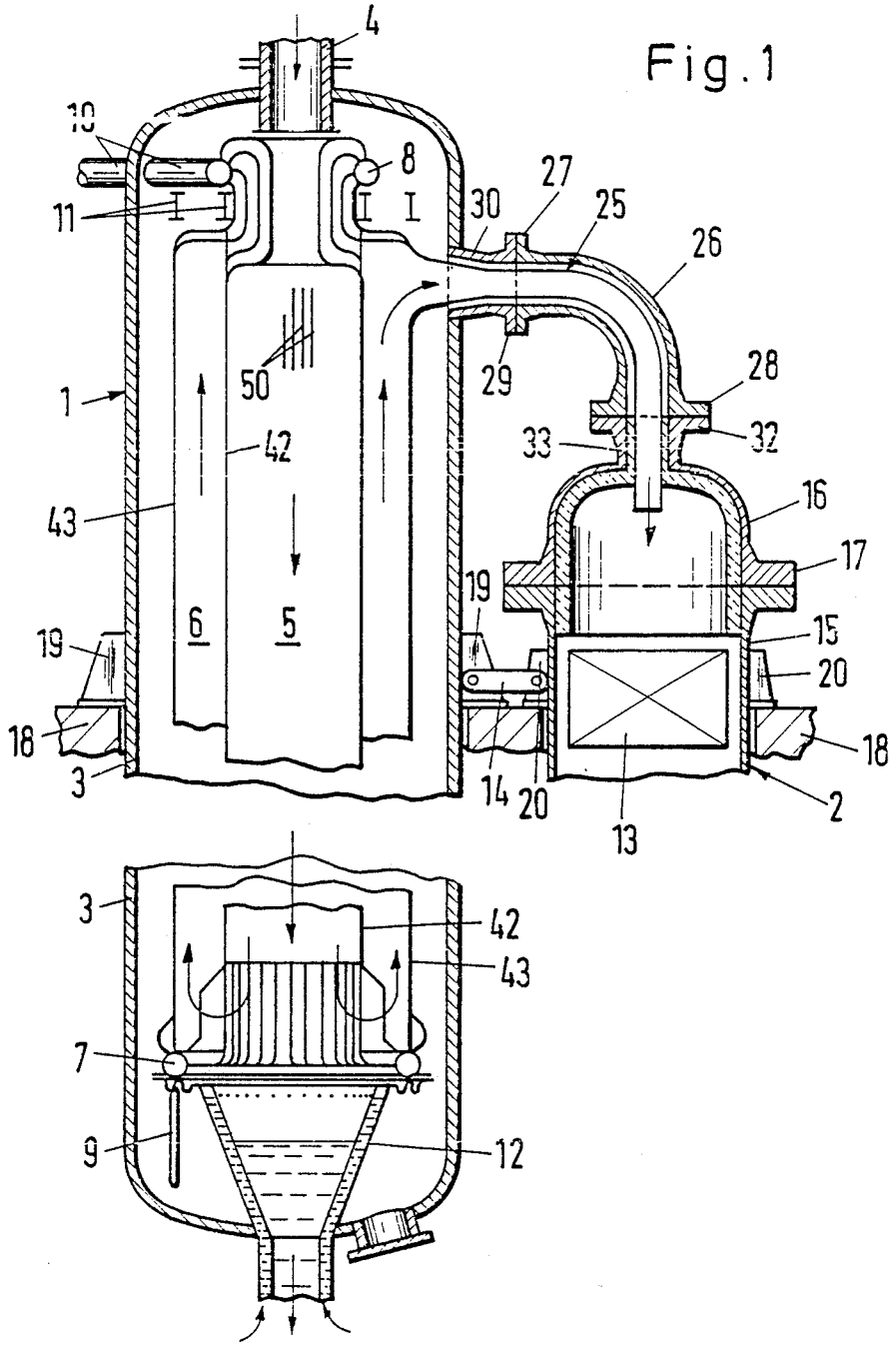

This invention relates to a hot-gas cooling plant. More particularly, this invention relates to a hot-gas cooling plant for a coal gasification plant.

Heretofore, various types of cooling plants have been provided for the cooling of hot gases, particularly from a coal gasification plant. For example, U.S. Pat. No. 4,328,007 describes a hot-gas cooling plant including a radiant cooler for receiving a hot gas flow and at least one convection cooler connected with the radiant cooler. In this respect, the radiant cooler is comprised of a substantially cylindrical pressure vessel having a vertical longitudinal axis, an insert of tubes disposed coaxially in the pressure vessel and a shell of tubes surrounding the insert. The top end of the insert is connected to the coal gasification plant via a gas supply duct which extends through the pressure vessel and forms a first gas flue to receive the hot gas while the insert and shell define an annular space which forms a second gas flue which is connected at a lower end to the first gas flue. The convection cooler which is disposed alongside the radiation cooler includes a substantially cylindrical pressure vessel having a vertical longitudinal axis and bunches of cooling tubes for cooling the hot-gas flow from the radiant cooler. To this end, a gas outlet line is connected between the two pressure vessels. As described, a straight portion of the gas outlet line extends through the cylindrical wall of the pressure vessel of the convection cooler and is followed by a bent portion which leads to a duct containing the convection heating surfaces inside the pressure vessel The disadvantage of this construction, however, is that the gas outlet line cannot be dismantled because most of the line extends inside the pressure vessel of the convection cooler.

Accordingly, it is an object of the invention to improve the construction of a hot-gas cooling plant to provide for ease of dismantling of a connection between two pressure vessels of adjacent coolers.

It is another object of the invention to be able to disconnect the coolers of a hot-gas cooling plant from each other in a simple manner.

Briefly, the invention is directed to a hot-gas cooling plant which is comprised of a radiant cooler having a first vertically disposed pressure vessel with a gas flue for a flow of hot gas, at least one convection cooler adjacent the radiant cooler having a second vertically disposed pressure vessel with cooling tubes therein and a gas outlet line extending from the pressure vessel of the radiant cooler on a curved axis to an upper end of the pressure vessel of the convection cooler. In this respect, the gas outlet line is in communication with the gas flue in the radiant cooler in order to receive a flow of hot gas while also being in communication with the interior of the pressure vessel of the convection cooler to deliver the hot gas thereto. In addition, the gas outlet line has a flange at each end for releasable connection to a flange on each respective pressure vessel.

As a result of this construction, the gas outlet line is always fully accessible over the entire length and can be easily dismantled by loosening the flange connections. This also greatly simplifies any maintenance work on the convention cooler, if carried out from above.

Figure 2:
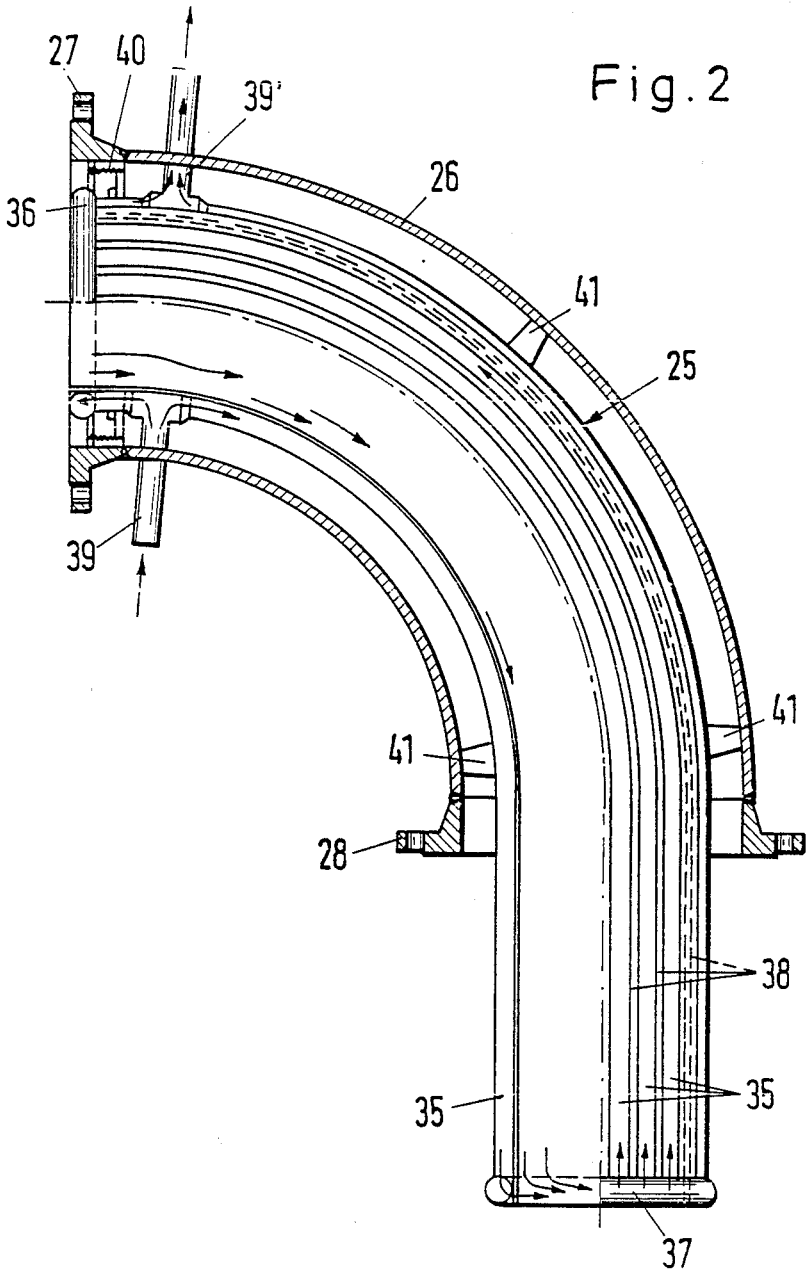

These and other objects and advantages of the invention will become more apparent from the following detailed description taken in conjunction with the accompanying drawings wherein:

FIG. 1 diagrammatically illustrates a vertical sectional view through a hot-gas cooling plant constructed in accordance with the invention; and FIG. 2 illustrates a cross sectional view of the gas outlet line of the plant of FIG. 1.

Referring to FIG. 1, the hot-gas cooling plant is constructed for use, for example, with a coal gasification plant. As illustrated, the plant includes a radiant cooler 1 and a convection cooler 2 only the top part of which is shown.

The radiant cooler 1 is constructed in known manner. For example, the cooler 1 includes a vertically disposed cylindrical pressure vessel 3 having a top end through which a gas supply duct 4 extends and is connected to a coal gasification reactor (not shown). The pressure vessel contains an insert 42 of tubes disposed coaxially in the vessel 3 in order to define a gas flue in communication with the gas supply duct 4. This insert 42 is made up of vertical, closely adjacent tubes 50 in order to convey the hot gas flow downwardly. In addition, a shell 43 of vertical tubes surrounds the insert 42 in order to define an annular second gas flue 6. The vertical tubes of the shell 43 are welded together in seal-tight manner like a diaphragm wall and the formed flue 6 is in communication with the first gas flue 5 so as to convey the gas upwardly as indicated by the arrows.

The tubes of the insert 42 and the shell 43 are connected to annular collectors 7, 8 at the bottom and top ends, respectively. The lowermost collector 7 is supplied via a line 9 with a coolant such as water which evaporates on flowing through the tubes and is discharged from the top collector 8 through a line 10.

The tubes of the insert 42 and shell 43 are suspended near the top end from a bearing system composed of sectional girders 11 so that the tubes can expand freely in the downward direction.

A downwardly tapering funnel 12 extends through the bottom of the pressure vessel 3 below the bottom collector 7 and is partially filled with water. The funnel 12 is used for trapping ash and particles of slag which are entrained by the stream of hot gas and which are thrown out when the gas is deflected from the inner gas flue 5 to the outer gas flue 6.

The convection cooler 2 is disposed alongside the radiant cooler 1 and includes a vertically disposed cylindrical pressure vessel 15 which contains bunches 13 cooling tubes, only one of which is shown in FIG. 1. This pressure vessel 15 is closed at the top by a cover 16 which is releasably connected by flanges 17 to the pressure vessel 15. As illustrated, the adjacent pressure vessels 3, 15 have lugs 19, 20, respectively, in the upper regions which bear on a common foundation 18.

A radially disposed gas outlet nozzle 30 is connected to the pressure vessel 3 at the upper end of the outer gas flue 6 and tapers conically in the direction of gas flow to a flange 29. As indicated, the tubes of the shell 43 are bent outwardly in a loop near the outlet nozzle 30 so that the tubes cover the inner surface of the nozzle 30 and the flange 29. As a result of the conical shape of the nozzle 30, the gas flow is stabilized.

A gas outlet line 26 serves to connect the pressure vessels 3, 15. As indicated, the gas outlet line 26 extends from the pressure vessel 3 on a curved axis to the upper end of the pressure vessel 15. In addition, the line 26 is in communication with the outer gas flue 6 of the radiant cooler 1 while being in communication with the interior of the pressure vessel 15 of the convection cooler 2. The line 26 also has a flange 27, 28 at each end for releasable connection to the flange 29 of the nozzle and a flange 32 on a spigot 33 on the cover 16 of the convection cooler 2. In each case, the flange connections are made by means of screws or bolts (not shown).

As indicated, the gas outlet line 26 is in the form of a 90° bend so that the flanges 27, 29 are at a right angle to the flanges 28, 32.

The outlet line 26 contains a line 25 which conveys the stream of gas. This line 25 begins at the flange 27 and extends in a 90° curve within the outlet line 26 and projects through the cover 16 into the interior of the pressure vessel 15 of the convection cooler 2. As illustrated in FIG. 2, the line 25 serves a means for cooling the gas outlet line 26. To this end, the gas line 25 comprises a plurality (for example sixteen) of correspondingly bent tubes 35 which are connected to an annular collector 36 at the top end and to an annular collector 37 at the bottom end Each pair of adjacent tubes 35 is welded together via interposed webs 38 so as to form a continuous curved body.

As indicated, the tube 35 which is bent with the smallest radius of curvature is connected to a coolant supply tube 39 near the top annular collector 36 so as to receive a supply of coolant. As indicated, the supply tube 39 is disposed radially and extends through the outlet line 26. In addition, the annular collector 36 is divided by two partitions into two chambers so that five tubes 35 on the inside of the curve illustrated in FIG. 2 are connected to one chamber while the remaining eleven tubes 35 on the outside of the curve are connected to the second collector chamber.

As also indicated, the tube 35 having the largest radius of curvature is connected with a radial coolant discharge tube 39' which extends through the outlet line 26.

The construction of the cooling means is such that a natural flow of coolant results and that the coolant supplied through the tube 39 flows downwardly in the five tubes 35 on the inside of the curve and then, after being collected and distributed in the collector 37, flows upwardly in the eleven tubes 35 on the outside of the curve. Thereafter, the heated coolant is discharged through the tube 39'.

As indicated, the coolant flowing into the tube 39 divides at the connection with the first tube 35 into two partial flows, one of which flows directly into the downward portion of the tube 35 whereas the other part flows to the annular collector 36 to be distributed among the remaining four down tubes. In like manner, two partial flows of coolant meet in the discharge tube 39', i.e. an upwardly flowing part in the tube 35 having the largest radius of curvature and a part of the remaining ascending tubes which reaches the tube 39' via the top chamber of the annular collector 36.

As shown in FIG. 2, the upper annular collector 36 is connected by a compensator 40 to the flange 27 of the gas outlet line 26 In addition, a number of radial supporting plates 41 are welded along the length of the line 25 and, when assembled, abut the inner surface of the connecting line 26. The place where the supply tube 39 and discharge tube 39' pass into the gas outlet line 26 can be constructed in the form of an expandable sealtight connection, i.e. in the form of "thermo-sleeves".

Referring to FIG. 1, a link 14 may be pivotally connected to the facing lugs 19, 20 at the upper regions of the pressure vessels 3, 15 of the coolers 1, 2 in order to take up horizontal forces acting on the pressure vessels 3, 15 and, thus relieve the gas outlet line 26 from these forces.

If the spacing between the pressure vessels 3, 15 is greater than that shown in FIG. 1, a straight tube portion can be inserted between the flanges 27, 29 of the outlet line 26 and the nozzle 30 . In this case, the link 14 must be made correspondingly longer In that case, the link 14 may be hollow and may be interconnected to the circuit of coolant flowing in the gas line 25.

As an alternative to the gas line 25, the line may be comprised of a bent tube having a smooth inner surface and tubes through which coolant flows and which are welded to the outside of the line. Alternatively, the gas line may be given a smooth inside surface if the line is made up of known tubes welded together and flowed through by a coolant.

The invention thus provides a hot-gas cooling plant wherein a gas outlet line between a radiant cooler and a convection cooler can be readily dismantled.

Further, the invention permits the gas outlet line to be fully accessible over the entire length and simplifies any maintenance work which may be required on the convection cooler if carried out from above.

What is claimed is:

1. A hot-gas cooling plant comprising a radiant cooler including a first vertically disposed cylindrical pressure vessel, an insert of tubes disposed coaxially in said pressure vessel to define a first gas flue, a gas supply duct in said pressure vessel connected to said insert in communication with said gas flue, and a shell of tubes surrounding said insert to define an annular second gas flue therebetween, said second gas flue being in communication with said first gas flue;

at least one convection cooler alongside said radiant cooler including a second vertically disposed cylindrical pressure vessel and bunches of cooling tubes in said second pressure vessel;

a gas outlet line extending from said first pressure vessel on a curved axis to an upper end of said second pressure vessel, said gas outlet line being in communication with said second gas flue and the interior of said second pressure vessel, said gas outlet line having a flange at each end for releasable connection to a flange on each respective pressure vessel;

a plurality of tubes in said gas outlet line for conveying a coolant therethrough and bent to follow said curved axis to cool said gas outlet line;

an annular collector within a gas intake end of said gas outlet line in communication with said bent tubes, each bent tube being in communication with at least one other bent tube at a gas exhaust end of said gas outlet line; and partitions in said collector for dividing said collector into two chambers, one of said chambers being in communication with some of said bent tubes and a coolant supply and the other of said chambers being in communication with others of said bent tubes and a coolant outlet.

2. A hot-gas cooling plant as set forth in claim 1 wherein said bent tubes extend into said second pressure vessel.

3. A hot-gas cooling plant as set forth in claim 2 which further comprises an annular collector at each end of said bent tubes and in communication with said tubes.

4. A hot-gas cooling plant as set forth in claim 3 wherein each said chamber is in communication with a different number of tubes from the other of said chambers.

5. A hot-gas cooling plant as set forth in claim 4 which further comprises a coolant supply connected to said chamber connected to the smaller number of said tubes and a coolant outlet connected to the other of said chambers whereby coolant flows by natural circulation through the remaining tubes.

6. A hot-gas cooling plant as set forth in claim 1 which further comprises a gas outlet nozzle connected between said second gas flue and said gas outlet line, said nozzle tapering in the direction of gas flow.

7. A hot-gas cooling plant as set forth in claim 1 which further comprises a hollow link connecting said vessels together below said gas outlet line.

8. A hot-gas cooling plant comprising a radiant cooler including a first vertically disposed pressure vessel having a gas flue for a flow of hot gas;

at least one convection cooler adjacent said radiant cooler and including a second vertically disposed pressure vessel having cooling tubes therein; and a gas outlet line extending from said first pressure vessel on a curved axis to an upper end of said second pressure vessel, said gas outlet line being in communication with said gas flue and the interior of said second pressure vessel, said gas outlet line having a flange at each end for releasable connection to a flange on each respective pressure vessel;

a plurality of tubes in said gas outlet line for conveying a coolant therethrough and bent to follow said curved axis to cool said gas outlet line;

an annular collector within a gas intake end of said gas outlet line in communication with said bent tubes, each bent tube being in communication with at least one other bent tube at a gas exhaust end of said gas outlet line; and partitions in said collector for dividing said collector into two chambers, one of said chambers being in communication with some of said bent tubes and a coolant supply and the other of said chambers being in communication with others of said bent tubes and a coolant outlet.

9. A hot-gas cooling plant as set forth in claim 8 wherein said tubes extend into said second pressure vessel.

10. A hot-gas cooling plant as set forth in claim 8 which further comprises an annular collector at each end of said tubes and in communication with said tubes and wherein each said chamber is in communication with a different number of tubes from the other of said chambers.

11. A hot-gas cooling plant as set forth in claim 8 which further comprises a gas outlet nozzle connected between said second gas flue and said gas outlet line, said nozzle tapering in the direction of gas flow.

* * * * *

UNITED STATES PATENT AND TRADEMARK OFFICE

CERTIFICATE OF CORRECTION

PATENT NO. : 4,959,078

DATED : Sept. 25, 1990

INVENTOR(S) : GEORG ZIEGLER

It is certified that error appears in the above-identified patent and that said Letters Patent is hereby corrected as shown below:

Column 1, line 34 change "vessel The" to -vessel. The-
Column 2, lines 48 to 49 change "13 cooling" to -13 of cooling-
Column 3, line 20 change "end Each" to -end. Each-
Column 3, line 59 change "26 In" to -26. In-
Column 4, line 8 change "longer In" to -longer. In-

Signed and Sealed this

Twenty-first Day of April, 1992

*Attest:*

HARRY F. MANBECK, JR.

*Attesting Officer*

*Commissioner of Patents and Trademarks*